US010767949B2

(12) United States Patent
Zung et al.

(10) Patent No.: US 10,767,949 B2
(45) Date of Patent: Sep. 8, 2020

(54) TWO-STAGE SAFETY SELECTORS FOR FIREARMS

(71) Applicant: Safe Operator Solutions LLC, Carrollton, GA (US)

(72) Inventors: Michael Zung, San Carlos, CA (US); John Mark Cobb, Carrollton, GA (US)

(73) Assignee: Safe Operator Solutions LLC, Carrollton, GA (US)

( * ) Notice: Subject to any disclaimer, the term of this patent is extended or adjusted under 35 U.S.C. 154(b) by 0 days.

(21) Appl. No.: 16/413,062

(22) Filed: May 15, 2019

(65) Prior Publication Data

US 2020/0025486 A1 Jan. 23, 2020

Related U.S. Application Data

(60) Provisional application No. 62/671,892, filed on May 15, 2018.

(51) Int. Cl.
*F41A 17/46* (2006.01)

(52) U.S. Cl.
CPC ..... *F41A 17/46* (2013.01)

(58) Field of Classification Search
CPC ..... F41A 17/46; F41A 17/00; F41A 17/52; F41A 17/56; F41A 17/62; F41A 17/64; F41A 17/70
USPC ..... 42/70.06, 70.01, 70.04, 70.05; 89/139, 89/142, 148, 150
See application file for complete search history.

(56) References Cited

U.S. PATENT DOCUMENTS

| | | | | |
|---|---|---|---|---|
| 2,379,946 | A * | 7/1945 | Baker | F41A 17/46 42/70.06 |
| 3,924,512 | A * | 12/1975 | Fagg | F41A 17/00 89/128 |
| 4,002,101 | A * | 1/1977 | Tellie | F41A 19/33 89/142 |
| 4,523,510 | A * | 6/1985 | Wilhelm | F41A 19/33 89/141 |
| 8,650,789 | B2 * | 2/2014 | Dionne | F41A 17/00 42/70.01 |
| 9,003,948 | B2 * | 4/2015 | Brown | F41A 19/33 42/70.01 |
| 9,995,549 | B1 * | 6/2018 | Hamby | F41A 19/46 |
| 2015/0198401 | A1 * | 7/2015 | Locher | F41A 17/46 42/70.06 |
| 2017/0370668 | A1 * | 12/2017 | Locher | F41A 17/46 |

* cited by examiner

*Primary Examiner* — John Cooper
(74) *Attorney, Agent, or Firm* — Thomas | Horstemeyer, LLP

(57) ABSTRACT

Disclosed are various embodiments of safety selector assemblies for firearms. In one embodiment, a safety selector assembly includes a body and a pivoting arm. A portion of the body is configured to be positioned within the frame of the firearm. The pivoting arm is pivotably mounted to the body of the safety selector assembly and is configured to selectively engage a safety selector stop tab that extends from the frame to restrict the body of the safety selector assembly from rotating when the pivoting arm is engaged with the safety selector stop tab.

23 Claims, 13 Drawing Sheets

TWO-STAGE SAFETY SELECTORS FOR FIREARMS

CROSS-REFERENCE TO RELATED APPLICATIONS

The present application is a non-provisional application of, and claims priority to, U.S. Application Ser. No. 62/671,892, titled "TWO-STAGE SAFETY SELECTOR FOR FIREARM" and filed on May 15, 2018, which is incorporated by reference herein in its entirety.

BACKGROUND

In a typical rifle, the safety selector is positioned within the frame of the rifle and interacts directly with the trigger/firing mechanism. A lever on the outside of the firearm casing is used to adjust the safety selector from the "safe" position to the "fire" position. While in "safe" position, the safety selector prohibits the trigger from being pulled by the operator. When the lever is rotated and the safety selector is switched to "fire" position, the safety selector portion within the frame allows the trigger to move, which in turn allows the hammer of the firearm to be released and rotate forward causing a round to be discharged.

Current safety selectors may only require a single input involving rotating a lever axially in a single plane, which provides a minimal safeguard to inadvertent activation. Moreover, because of the lever's position on the external casing of the rifle, it is highly susceptible to being inadvertently activated by an operator's hands or other external sources, all of which may result in the safety selector inadvertently being defeated and switched to the "fire" position. Such mistakes can prove to be fatal.

BRIEF DESCRIPTION OF THE DRAWINGS

Many aspects of the present disclosure can be better understood with reference to the following drawings. The components in the drawings are not necessarily to scale, with emphasis instead being placed on clearly illustrating the principles of the disclosure. Moreover, in the drawings, like reference numerals designate corresponding parts throughout the several views.

DETAILED DESCRIPTION

The present disclosure relates to two-level safety selectors for firearms that may require the firearm operator to input two independent and multi-directional movements to move the safety selector from the "safe" position to the "fire" position.

Figure 1:
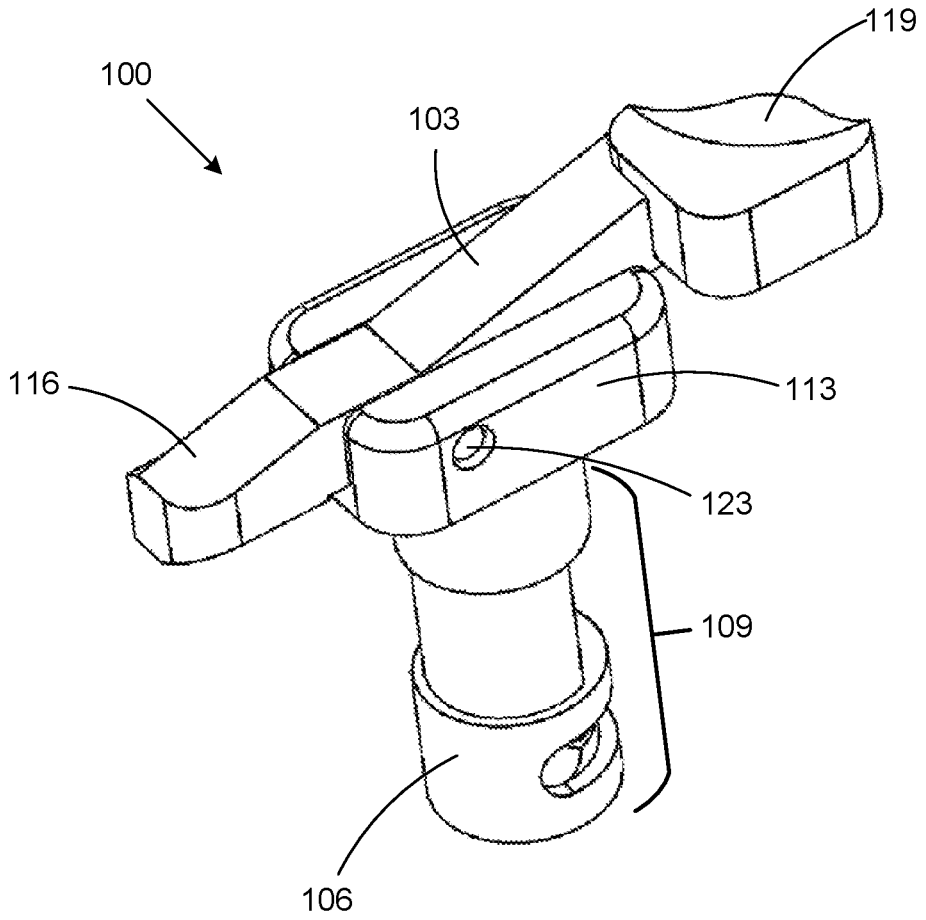
FIG. 1 is a perspective view of a first example of a safety selector assembly according to various embodiments of the present disclosure.

With reference to FIG. 1, shown is an example of a first example of a safety selector assembly 100 according to various embodiments of the present disclosure. In particular, FIG. 1 shows a perspective view of the safety selector assembly 100. The safety selector assembly 100 can comprise a pivoting arm 103 and a body 106. The body 106 can include a cylindrical portion 109 that is inserted into, and is retained within, the frame of the frame of the firearm. The body 106 can also include a head 113 that extends outside of the frame.

The pivoting arm 103 can include a first end 116 and a second end 119. The safety selector assembly 100 can also include a pin 123 that extends through the head 113 of the body 106 and the pivoting arm 103. The pin 123 can define a pivot axis about which the pivoting arm 103 can rotate. The first end 116 of the pivoting arm 103 can be configured to contact and thereby engage a safety selector stop tab that extends from the frame of the firearm. The second end 119 of the pivoting arm 103 can be pressed by the firearm operator to disengage the pivoting arm 103 and the first end 116 from the safety selector stop tab.

Safety selector stop tabs can extend from the side of a frame of a firearm, such as the lower receiver of a United States defense standard ("MIL-SPEC") AR-15-style rifle. When a conventional safety selector is installed in the frame, the safety selector stop tabs can prevent the safety selector from over-rotating beyond the safe position and fire position, respectively. In accordance with various embodiments of the present disclosure, a safety selector stop tab is utilized as a mechanism that restricts the safety selector assembly 100 from being unintentionally switched from the safe position to the fire position.

Figure 2:
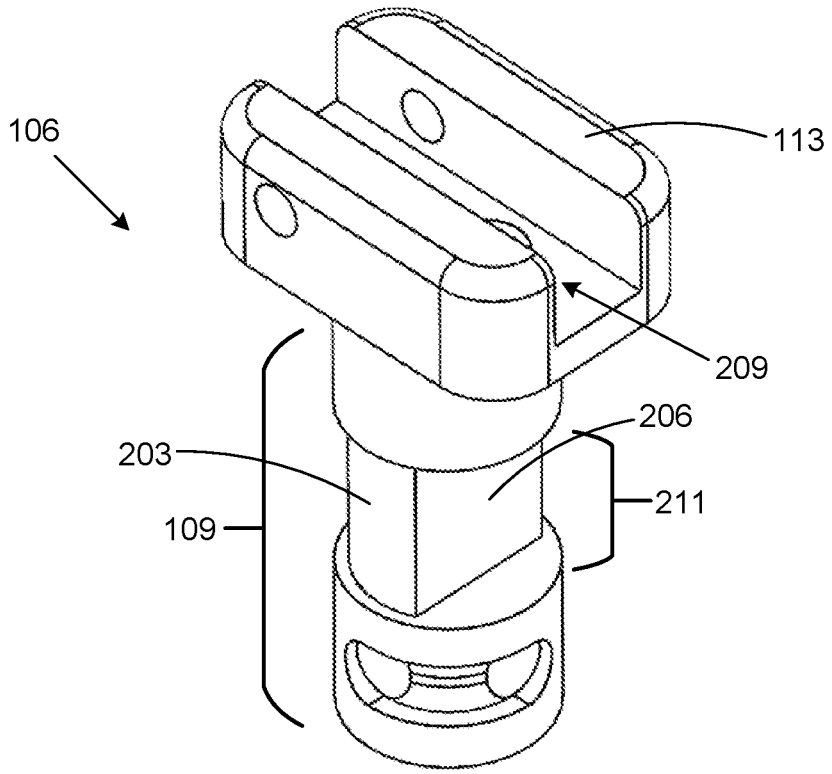
FIG. 2 is a perspective view of a body for the first example of the safety selector assembly of FIG. 1 according to various embodiments of the present disclosure.

With reference to FIG. 2, shown is a perspective view of the body 106 of the safety selector assembly 100. The cylindrical portion 109 of the body 106 can include a curved surface 203 and a flat surface 206. When the safety selector assembly 100 is installed in the frame and in the safe position, the curved surface 203 of the body 106 can engage with the trigger of the firearm and prevent the trigger from moving. In this way, the safety selector assembly can prevent the trigger from being pulled and causing a round to be fired.

When the safety selector assembly 100 is rotated to the fire position, the body 106 rotates accordingly, and a recessed area 211 of the cylindrical portion 109 formed by the flat surface 206 allows the trigger to move. In this way, the safety selector assembly 100 can allow the trigger to be pulled and cause a round to be fired.

As shown in FIG. 2, the head 113 of the body 106 can include a channel 209. The pivoting arm 103 of the safety selector assembly 100 can be positioned within the channel 209.

Figure 3:
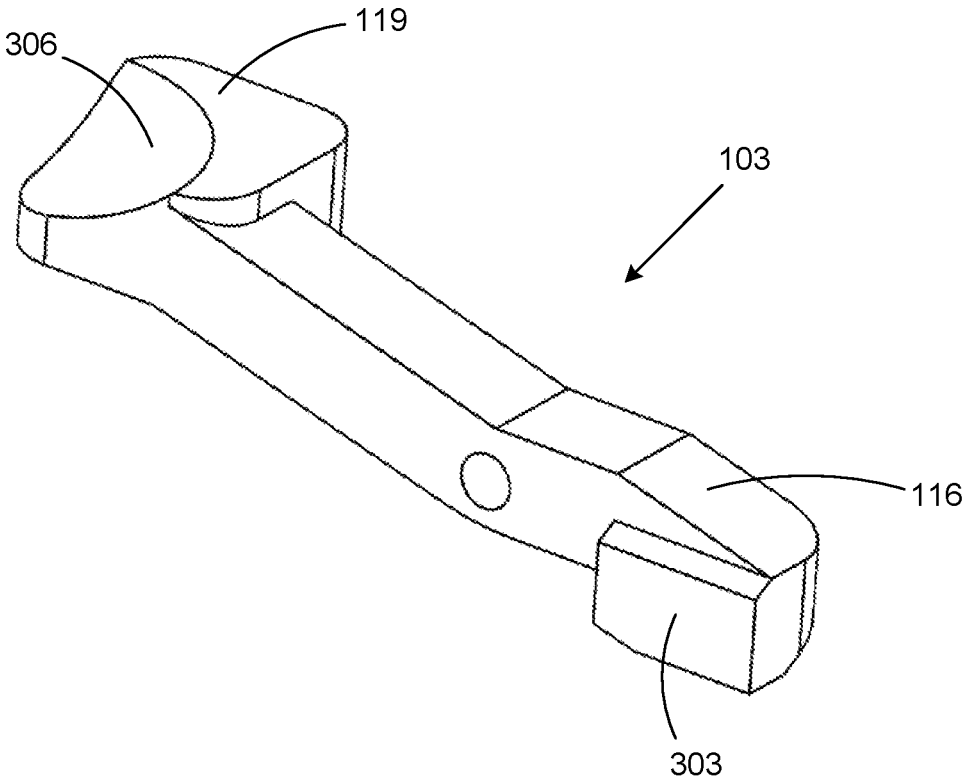
FIG. 3 is a perspective view of a pivoting arm for the first example of the safety selector assembly of FIG. 1 according to various embodiments of the present disclosure.

With reference to FIG. 3, shown is the pivoting arm 103 of the safety selector assembly 100 according to various embodiments of the present disclosure. As shown, the first end 116 of the pivoting arm 103 can include a protrusion 303 that contacts the safety selector stop tab (not shown) that extends from the side of the frame.

The second end 119 of the pivoting arm 103 can include a recessed region 306 shaped to conform somewhat to an operator's thumb. The operator can press the recessed region 306 of the pivoting arm 103 to cause the pivoting arm 103 to rotate about the pivot axis discussed above.

Figure 4:
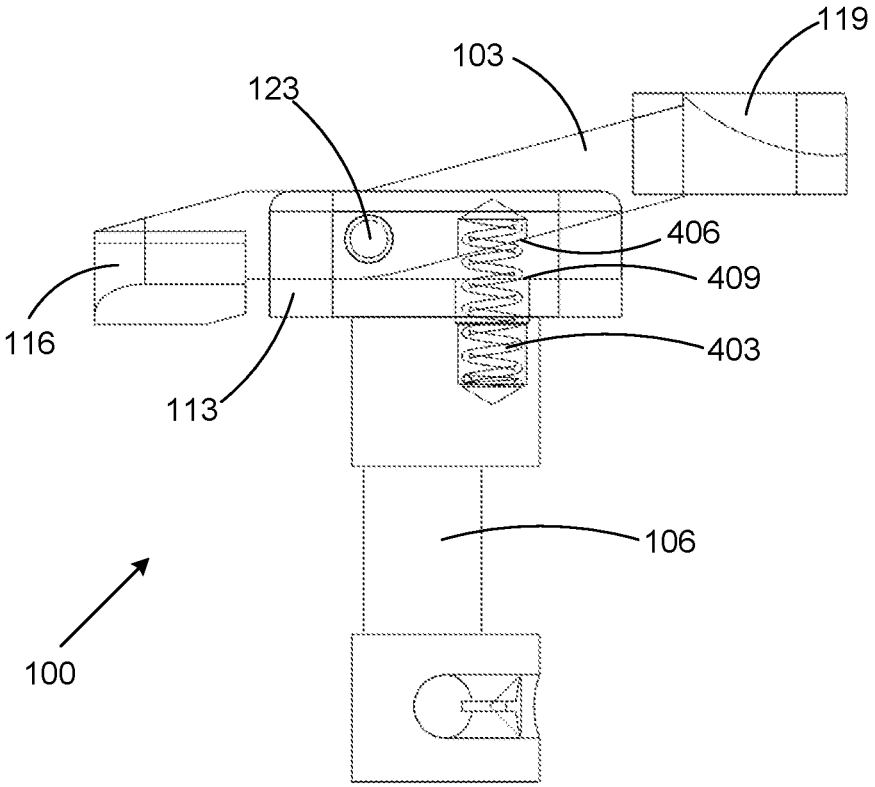
FIG. 4 is a side view of the first example of the safety selector assembly of FIG. 1 according to various embodiments of the present disclosure.

With reference to FIG. 4, shown is a side view of the safety selector assembly 100, with internal components depicted. As shown in FIG. 4, the safety selector assembly 100 can include a compression spring 403. The compression spring 403 can exert a force that causes the pivoting arm 103 to be maintained in a position that engages with the safety selector stop tab of the frame when the safety selector assembly 100 is in the safe position. The operator of the firearm can overcome this force provided by the compression spring 403 by pressing on the second end 119 of the pivoting arm 103, thereby causing the pivoting arm 103 to rotate about the pin 123 and disengage from the safety selector stop tab.

As shown in FIG. 4, the pivoting arm 103 can include a recessed region 406 that receives an end of the compression spring 403. Similarly, the body 106 can include a recessed region 409 that receives the opposite end of the compression spring 403. The recessed region 406 in the pivoting arm 103 and the recessed region 409 in the body 106 can retain the compression spring 403 in the proper position to provide the force described above.

Figure 5:
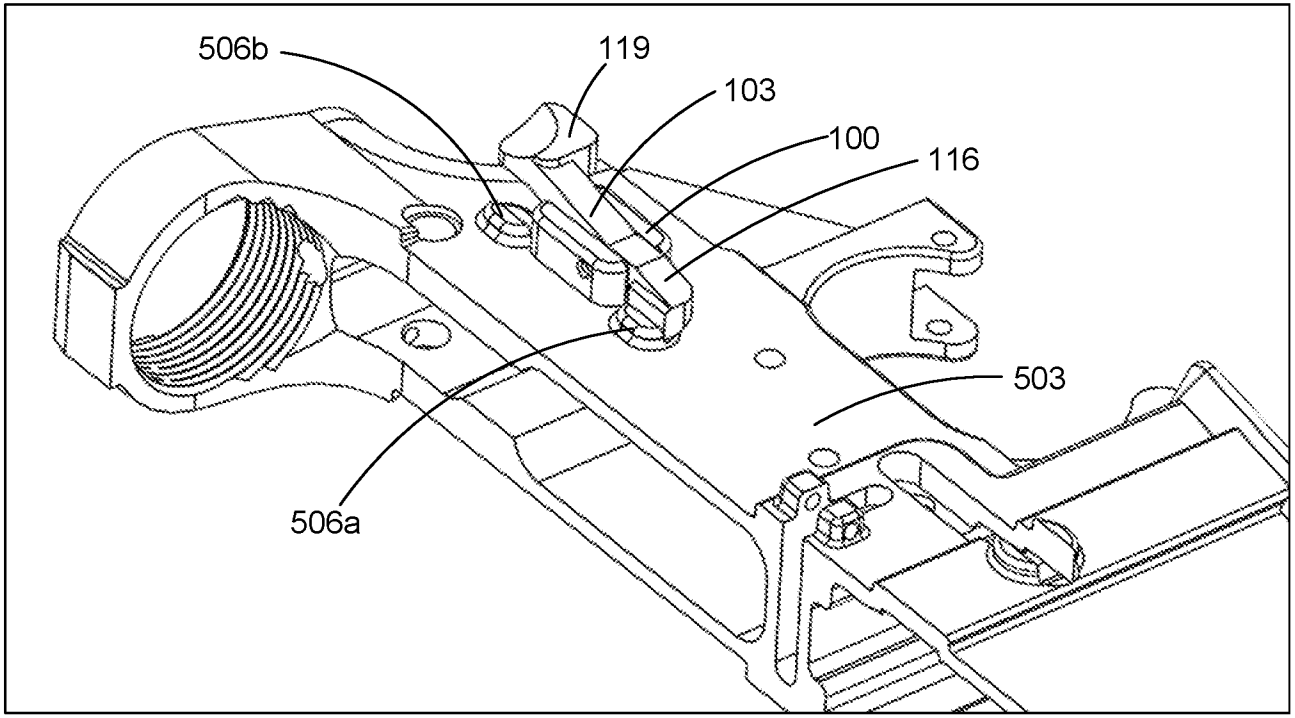
FIG. 5 is a perspective view of the first example of the safety selector assembly of FIG. 1 installed in a frame, with the safety selector assembly in a safe position.

With reference to FIG. 5, shown is a perspective view of the safety selector assembly 100 installed in a frame 503 of a firearm. As shown in FIG. 5, the frame 503 can have a front safety selector stop tab 506*a* and a rear safety selector stop tab 506*b* extending from the left side of the frame 503.

When the safety selector assembly 100 is in the position shown, the safety selector assembly 100 is in a safe position, and the trigger (not shown) is prevented from being pulled to fire the firearm. As shown in FIG. 5, the first end 116 of the pivoting arm 103 has engaged and makes contact with the front safety selector stop tab 506*a* of the frame 503. Because the front safety selector stop tab 506*a* extends from the side wall of the frame 503, the front safety selector stop tab 506*a* restricts the safety selector assembly 100 from unintentionally rotating from the safe position, as shown in FIG. 5, to a fire position.

Figure 6:
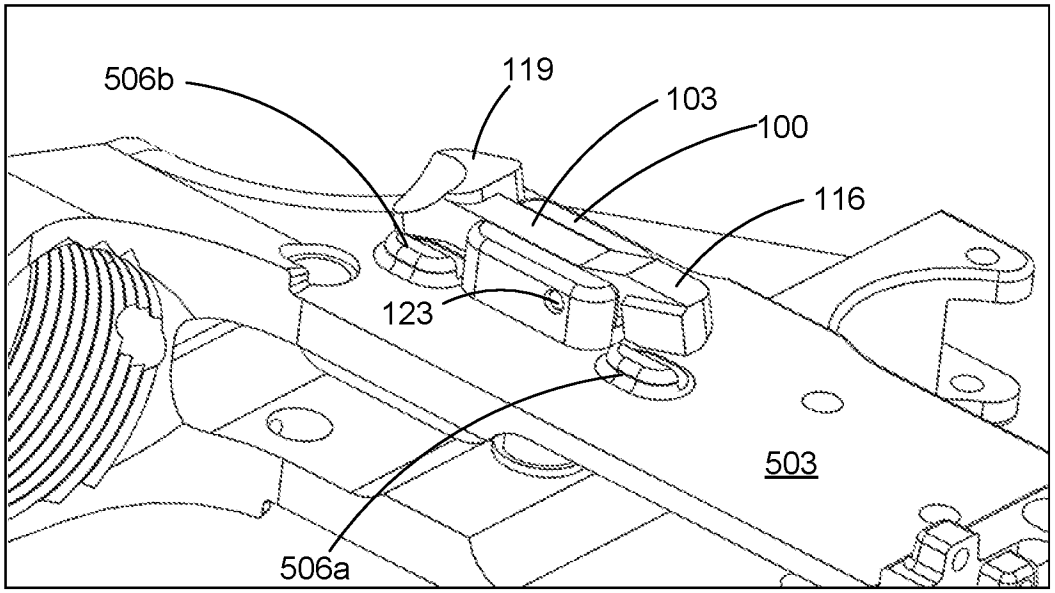
FIG. 6 is a perspective view of the first example of the safety selector assembly of FIG. 1 installed in a frame, with the pivoting arm of the safety selector assembly disengaged from a safety selector stop tab extending from the frame.

With reference to FIG. 6, shown is a perspective view of the safety selector assembly 100 of FIG. 5 with the pivoting arm 103 of the safety selector assembly 100 disengaged from the front safety selector stop tab 506*a* that extends from the side of the frame 503. As shown, the pivoting arm 103 has been rotated about the pin 123 such that the first end 116 no longer contacts the front safety selector stop tab 506*a*. In this position, the pivoting arm 103 can rotate clear of the front safety selector stop tab 506*a*.

Figure 7:
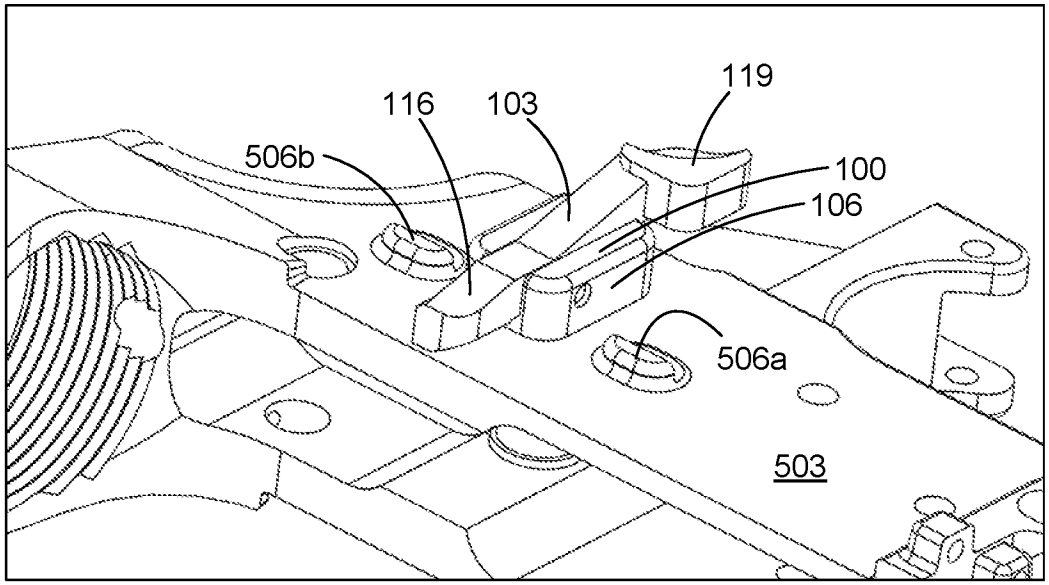
FIG. 7 is a perspective view of the first example of the safety selector assembly of FIG. 1 installed in a frame, with the safety selector assembly in a fire position.

With reference to FIG. 7, shown is a perspective view of the safety selector assembly 100 in the fire position. In particular, the pivot arm 103 has been rotated from the position shown in FIG. 6 to the position shown in FIG. 7. Rotating the pivoting arm 103 in this way causes the body 106 of the safety selector assembly to rotate within the frame to a position in which the trigger is allowed to be pulled to discharge the firearm, as discussed above.

Figure 8:
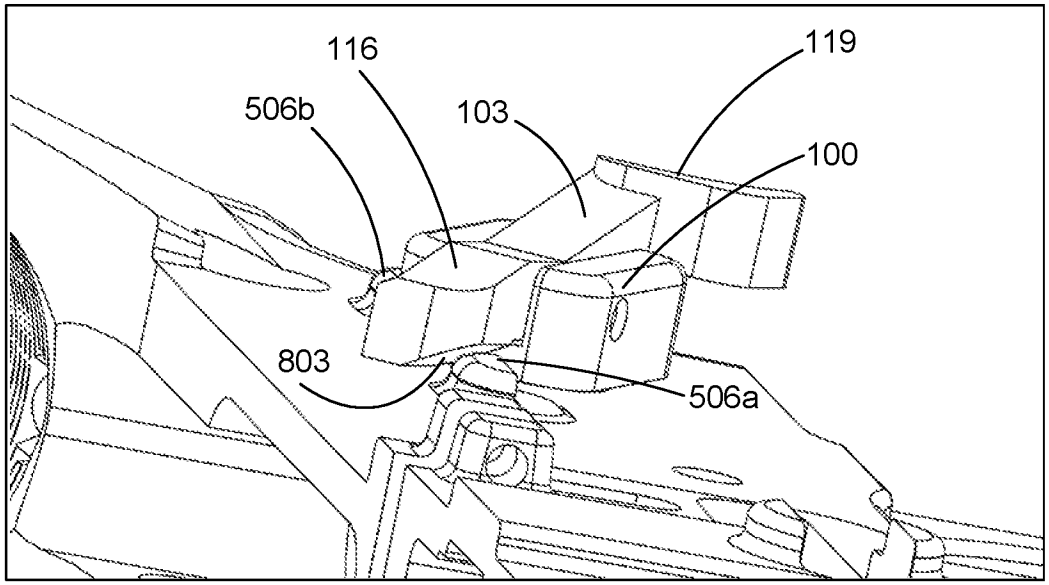
FIG. 8 is a perspective view of the first example of the safety selector assembly of FIG. 1 installed in a frame, with the safety selector assembly being returned to the safe position.

With reference to FIG. 8, shown is a perspective view of the safety selector assembly 100 being moved from the fire position (FIG. 7) to the safe position (FIG. 5). As shown in FIG. 8, the first end 116 of the pivoting arm 103 can include a tapered surface 803 that facilitates the pivoting arm 103 overcoming the front safety selector stop tab 506*a* when the safety selector assembly 100 is being moved from the fire position to the safe position. Accordingly, the operator can move the safety selector assembly 100 from the fire position to the safe position without pressing on the second end 119 of the pivoting arm 103 to rotate the pivoting arm 103 away from the frame 503.

Figure 9A:
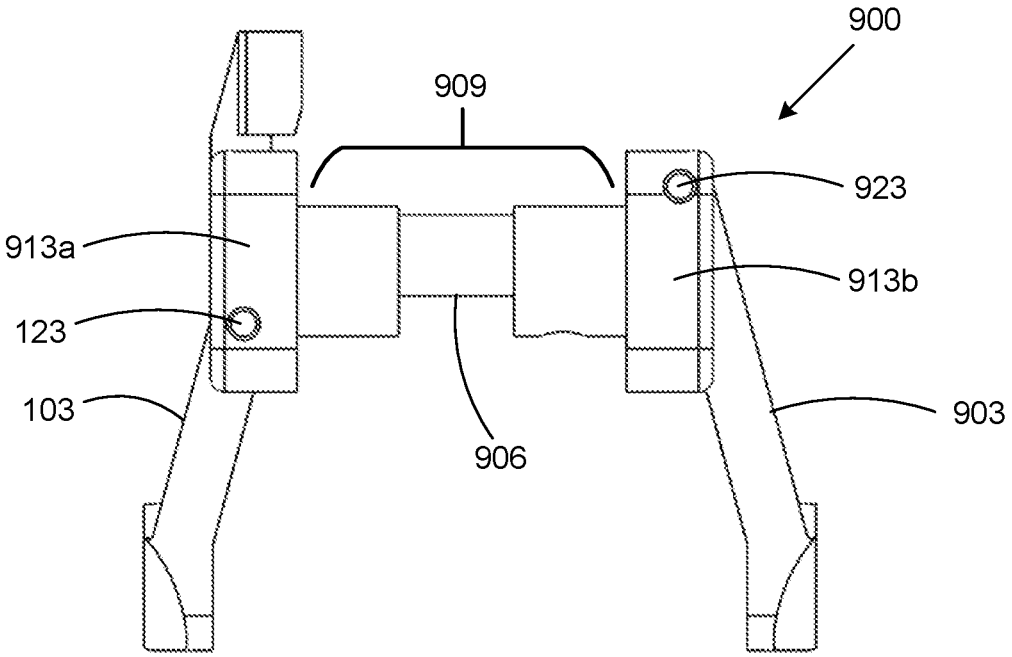
FIG. 9A is a top view of a second example of a safety selector assembly according to various embodiments of the present disclosure.
Figure 9B:
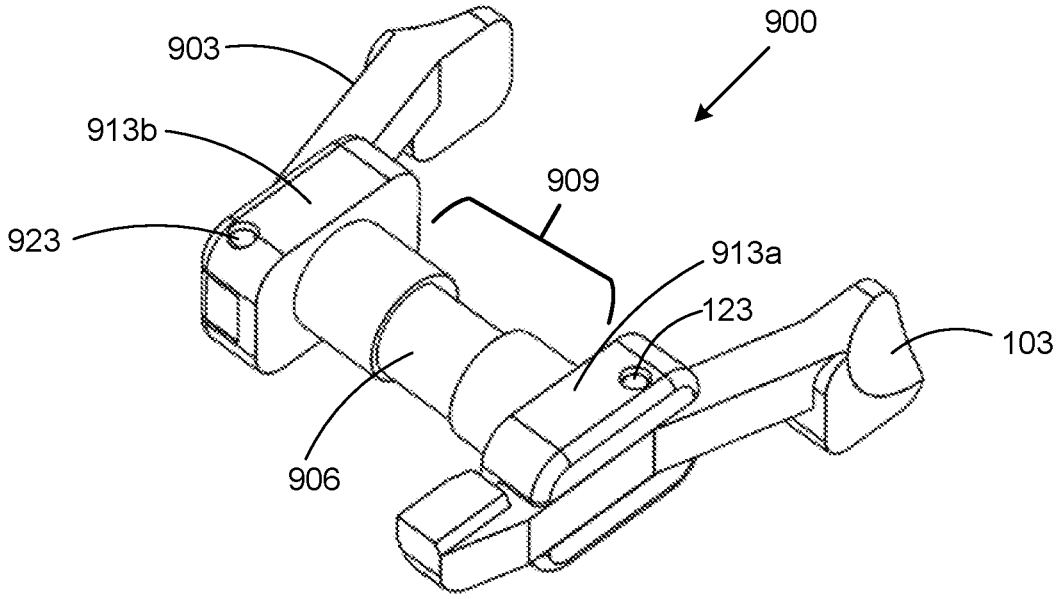
FIG. 9B is a perspective view of the second example of the safety selector assembly of FIG. 9 according to various embodiments of the present disclosure.

With reference to FIGS. 9A-9B, shown is a second example of a safety selector assembly, referred to herein as the safety selector assembly 900. In particular, FIG. 9A shows a top view of the safety selector assembly 900, and FIG. 9B shows a perspective view of the safety selector assembly 900. The safety selector assembly 900 can be an ambidextrous safety selector.

The safety selector assembly 900 can have components similar to the safety selector assembly 100. For example, the safety selector assembly 900 can include the same pivoting arm 103 and pin 123 as discussed above with respect to the safety selector assembly 100. The safety selector assembly 900 can also include a body 906 that has a cylindrical portion 909 and a first head 913*a* similar to the cylindrical portion 109 and the head 113 of the safety selector assembly 100. The body can also include a second head 913*b* similar to the head 113 discussed above with respect to the safety selector assembly 100.

Additionally, the safety selector assembly 900 can include a second pivoting arm 903 and a second pin 923, which extends through the second head 913*b* and the second pivoting arm 903. The second pivoting arm 903 can pivot about the second pin 923.

Figure 10:
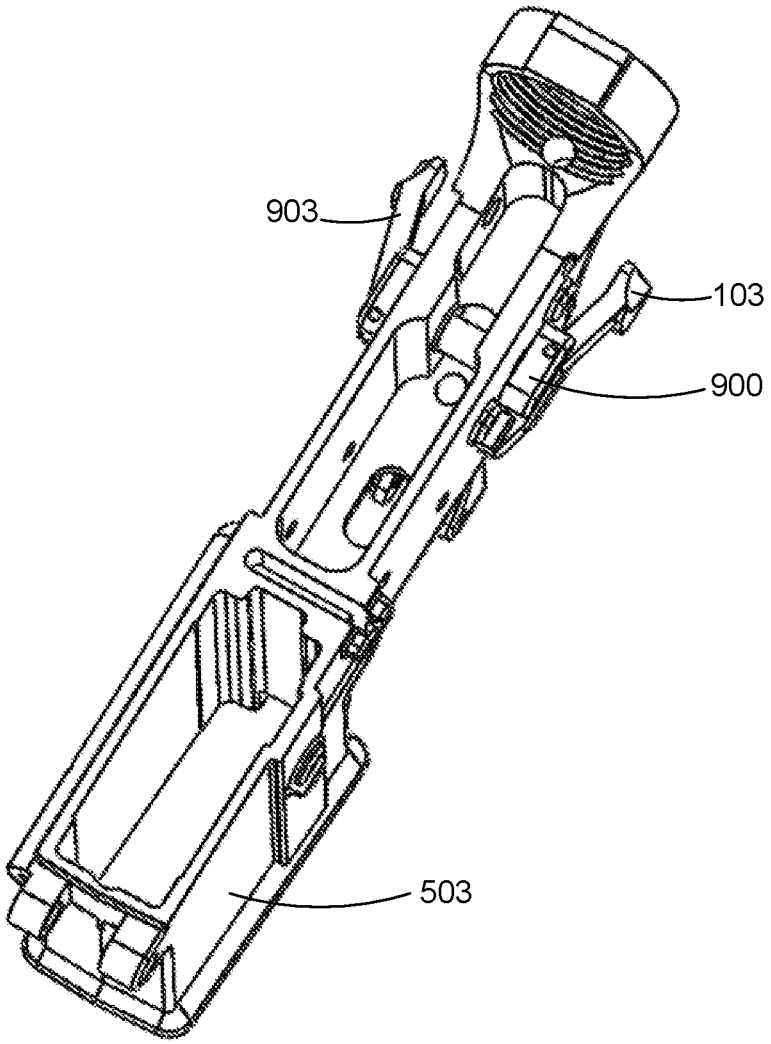
FIG. 10 is a perspective view of the second example of the safety selector assembly of FIG. 9 installed in a frame according to various embodiments of the present disclosure.

With reference to FIG. 10, shown is a perspective view of the safety selector assembly 900 installed in the frame of a firearm. As shown, the safety selector assembly 900 can be installed such that the first pivoting arm 103 is on the left side of the frame 503, and the second arm 903 is on the right side of the frame 503.

Figure 11:
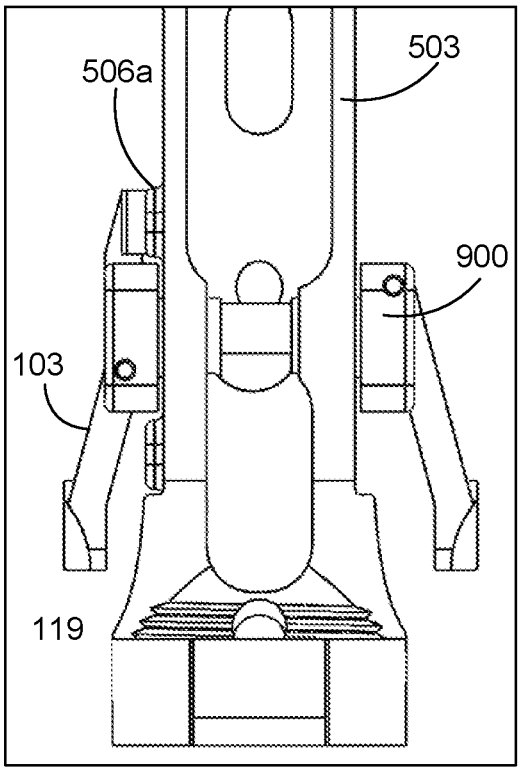
FIG. 11 is a top view of the second example of the safety selector assembly of FIG. 9 installed in a frame, with the safety selector assembly in a safe position.

With reference to FIG. 11, shown is a top view of the safety selector assembly 900 installed in the frame 503. In particular, FIG. 11 shows the safety selector assembly 900 in a safe position. As shown, the first arm 103 of the safety selector assembly 900 engages with the front safety selector stop tab 506*a* in the same way described above with respect to the safety selector assembly 100. In this way, the first pivoting arm 103 can prevent the safety selector assembly 900 from being unintentionally rotated to the fire position.

Figure 12:
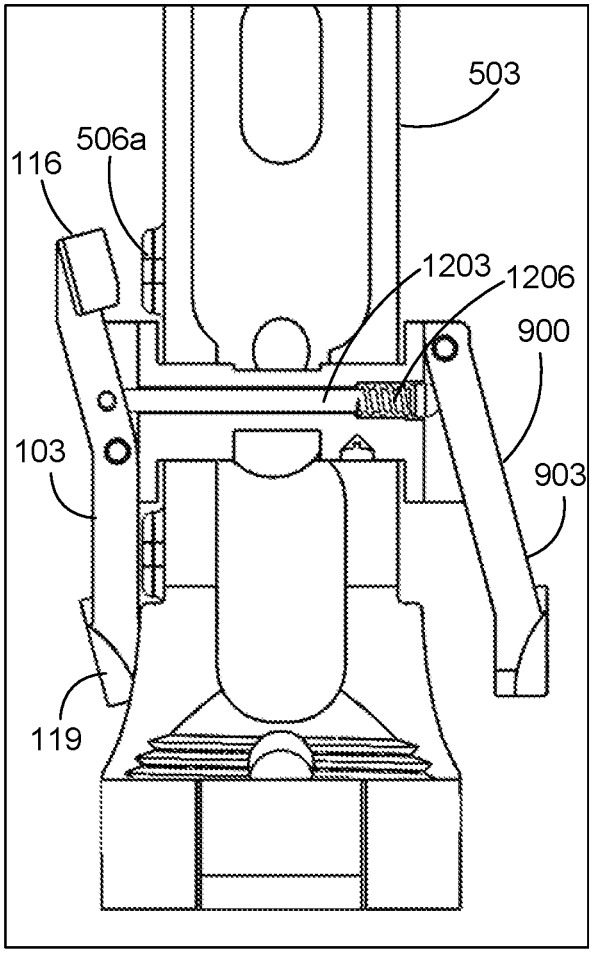
FIG. 12 is a top view of the second example of the safety selector assembly of FIG. 9 installed in a frame, with the first pivoting arm of the safety selector assembly disengaged from a safety selector stop tab extending from the frame.

With reference to FIG. 12, shown is a top view of the safety selector assembly 900 with internal components depicted. In particular, FIG. 12 shows the safety selector assembly 900 in a position with the first pivoting arm 103 depressed such that the first end 116 has been disengaged from the front safety selector stop tab 506*a*. In this position, the safety selector assembly 900 is allowed to rotate from the safe position to the fire position.

As shown in FIG. 12, the safety selector assembly 900 can include a rod 1203 and a compression spring 1206 positioned between the first pivoting arm 103 and the second pivoting arm 903. The rod 1206 with the force provided by the compression spring 1206 can cause the first end 116 of the first pivoting arm 103 to be in contact with the first safety selector stop tab 506*a* or the side of the frame 503 when the second end 119 is not depressed. The compression spring 1206 can also cause the second pivoting arm 903 to be extended away from the side of the frame 503 when the second pivoting arm 903 is not depressed.

Figure 13:
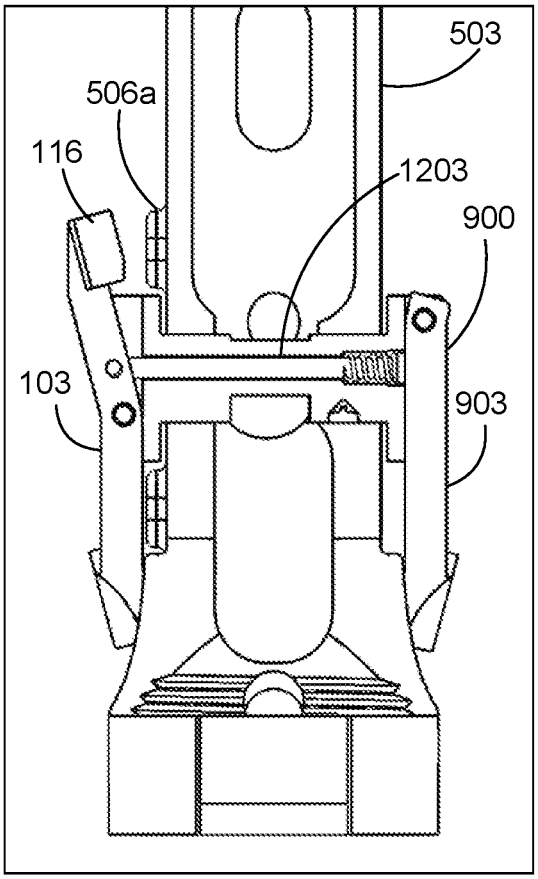
FIG. 13 is a top view of the second example of the safety selector assembly of FIG. 9 installed in a frame, with the first and second pivoting arms of the safety selector assembly disengaged from a safety selector stop tab extending from the frame.

With reference to FIG. 13, shown is a top view of the safety selector assembly 900 with internal components depicted. In particular, FIG. 13 shows the safety selector assembly 900 in a position with the second pivoting arm 903 depressed. The second pivoting arm 903 can be depressed as shown in FIG. 13 by, for example, the operator of the firearm pressing on the second pivoting arm 903. When the second pivoting arm 903 is depressed, the second pivoting arm 903 can cause the rod 1203 to slide within the frame 503, thereby causing the first pivoting arm 103 to pivot to the position shown, such that the first end 116 of the first pivoting arm 903 disengages from the front safety selector stop tab 506*a*. In this position, the safety selector assembly 900 is allowed to rotate from the safe position to the fire position, as described above.

It is emphasized that the above-described embodiments of the present disclosure are merely possible examples of implementations set forth for a clear understanding of the principles of the disclosure. Many variations and modifications may be made to the above-described embodiments without departing substantially from the spirit and principles of the disclosure. All such modifications and variations are intended to be included herein within the scope of this disclosure.

Therefore, the following is claimed:

1. A firearm, comprising:

a frame comprising a safety selector stop tab extending from a side wall of the frame; and a safety selector assembly installed in the frame, the safety selector assembly comprising:

a body, wherein at least a portion of the body is positioned within the frame; and a pivoting arm that is pivotably mounted to the body of the safety selector assembly, wherein the pivoting arm is configured to selectively engage the safety selector stop tab to restrict the body of the safety selector assembly from rotating when the pivoting arm is engaged with the safety selector stop tab.

2. The firearm of claim 1, wherein the pivoting arm of the safety selector assembly comprises a first end and a second end, the first end of the pivoting arm being configured to contact the safety selector stop tab, the second end of the pivoting arm being configured to be pressed by an operator of the firearm to disengage the pivoting arm from the safety selector stop tab.

3. The firearm of claim 1, wherein the body of the safety selector assembly comprises a channel, and wherein at least a portion of the pivoting arm of the safety selector assembly is positioned within the channel of the body.

4. The firearm of claim 3, wherein the safety selector assembly further comprises a pin that extends through the pivoting arm of the safety selector assembly and the channel of the body.

5. The firearm of claim 1, wherein the safety selector assembly further comprises a spring configured to maintain the pivoting arm in engagement with the safety selector stop tab.

6. The firearm of claim 5, wherein the body of the safety selector assembly comprises a receptacle for the spring, and wherein the pivoting arm of the safety selector assembly comprises a second receptacle for the spring.

7. The firearm of claim 1, wherein the safety selector assembly further comprises an additional pivoting arm, the additional pivoting arm being configured to cause the pivoting arm to selectively disengage the safety selector stop tab.

8. The firearm of claim 1, wherein the safety selector assembly is an ambidextrous safety selector assembly.

9. An apparatus, comprising:

a firearm safety selector assembly that comprises:

a body, wherein at least a portion of the body is configured to be positioned within a frame of a firearm; and a pivoting arm that is pivotably mounted to the body of the firearm safety selector assembly, wherein the pivoting arm is configured to selectively engage a safety selector stop tab that extends from the frame to restrict the body of the safety selector assembly from rotating when the pivoting arm is engaged with the safety selector stop tab, and wherein the pivoting arm is further configured to selectively disengage the safety selector stop tab to facilitate the body of the safety selector assembly being rotated when the pivoting arm is disengaged from the safety selector stop tab.

10. The apparatus of claim 9, wherein the pivoting arm of the firearm safety selector assembly comprises a first end and a second end, the first end of the pivoting arm being configured to contact the safety selector stop tab, the second end of the pivoting arm being configured to be pressed by an operator of the firearm to disengage the pivoting arm from the safety selector stop tab.

11. The apparatus of claim 9, wherein the body of the firearm safety selector assembly comprises a channel, and wherein at least a portion of the pivoting arm of the firearm safety selector assembly is positioned within the channel of the body.

12. The apparatus of claim 11, wherein the firearm safety selector assembly further comprises a pin that extends through the pivoting arm of the firearm safety selector assembly and the channel of the body.

13. The apparatus of claim 9, wherein the firearm safety selector assembly further comprises a spring configured to maintain the pivoting arm in engagement with the safety selector stop tab.

14. The apparatus of claim 9, wherein the firearm safely selector assembly further comprises an additional pivoting arm, the additional pivoting arm being configured to cause the pivoting arm to selectively disengage the safety selector stop tab.

15. The apparatus of claim 9, wherein the firearm safety selector assembly is an ambidextrous safety selector assembly.

16. A method, comprising:

positioning a pivoting arm of a firearm safety selector assembly such that the pivoting arm engages a safety selector stop tab extending from a side wall of a frame, thereby restricting rotation of a body of the firearm safety selector assembly;

disengaging the pivoting arm from the safety selector stop tab extending from the side wall of the frame by at least pivoting the pivoting arm in relation to the side wall of the frame, thereby facilitating rotation of the body of the firearm safety selector assembly; and rotating the pivoting arm, of the firearm safety selector assembly to cause the body of the safety selector assembly to rotate.

17. The method of claim 16, wherein the frame is in a safe state when the firearm safety selector assembly is positioned such that the pivoting arm engages the safety selector stop tab.

18. The method of claim 16, wherein the step of rotating the pivoting arm of the firearm safety selector assembly causes the frame to enter a fire state.

19. The method of claim 16, wherein disengaging the pivoting arm from the safety selector stop tab comprises rotating the pivoting arm relative to the side wall of the frame.

20. The method of claim 16, wherein disengaging the pivoting arm from the safety selector stop tab comprises pivoting the pivoting arm relative to the side wall of the frame such that the pivoting arm does not contact the safety selector stop tab.

21. The method of claim 16, wherein positioning the pivoting arm such that the pivoting arm engages the safety selector stop tab comprises reducing a force applied to the pivoting arm.

22. The method of claim 16, wherein positioning the pivoting arm such that the pivoting arm engages the safety selector stop tab comprises rotating the pivoting arm such that the pivoting arm contacts the safety selector stop tab.

23. The method of claim 16, wherein disengaging the pivoting arm from the safety selector stop tab extending from the side wall of the frame, thereby facilitating rotation of the body of the firearm safety selector assembly, comprises rotating an additional pivoting arm.

* * * * *